US006227126B1

(12) United States Patent
Wagner

(10) Patent No.: US 6,227,126 B1
(45) Date of Patent: May 8, 2001

(54) MOLTEN METAL REACTOR AND TREATMENT METHOD FOR TREATING GASEOUS MATERIALS AND MATERIALS WHICH INCLUDE VOLATILE COMPONENTS

(75) Inventor: Anthony S. Wagner, Bee Caves, TX (US)

(73) Assignee: Clean Technologies, International Corporation, Lakeway, TX (US)

( * ) Notice: Subject to any disclaimer, the term of this patent is extended or adjusted under 35 U.S.C. 154(b) by 0 days.

(21) Appl. No.: 09/232,406

(22) Filed: Jan. 15, 1999

(51) Int. Cl.[7] ..... F23G 5/00

(52) U.S. Cl. ..... 110/250; 110/203; 110/215; 110/342; 422/184.1; 423/659; 423/DIG. 18; 588/201

(58) Field of Search ..... 110/203, 215, 110/250, 255, 257, 258, 259, 346, 342, 341; 422/184.1; 423/659, DIG. 12, DIG. 18; 588/201

(56) References Cited

U.S. PATENT DOCUMENTS

| | | | | |
|---|---|---|---|---|
| 4,552,667 | | 11/1985 | Shultz . | |
| 4,666,696 | | 5/1987 | Shultz . | |
| 4,770,109 | * | 9/1988 | Schlienger | 110/250 X |
| 4,787,320 | | 11/1988 | Raaness et al. . | |
| 5,000,101 | | 3/1991 | Wagner . | |
| 5,143,000 | * | 9/1992 | Camacho | 110/250 |
| 5,452,671 | | 9/1995 | Wagner . | |
| 5,461,991 | | 10/1995 | Wagner . | |
| 5,711,017 | * | 1/1998 | Bitler et al. | 110/346 X |
| 5,925,165 | * | 7/1999 | Pflugl et al. | 110/250 X |
| 6,069,290 | * | 5/2000 | Wagner | 588/201 X |

* cited by examiner

*Primary Examiner*—Ira S. Lazarus
*Assistant Examiner*—Ljiljana V. Ciric
(74) *Attorney, Agent, or Firm*—Russell D. Culbertson; Shaffer & Culbertson, LLP

(57) ABSTRACT

An elongated reaction chamber (11) has an inlet end (23), an outlet end (25), and a gas containment boundary (12) extending along its length. Waste material to be processed is injected into the reaction chamber (11) at the inlet end (23) and reaction products are removed from the reaction chamber out the outlet end (25). The reaction chamber (11) is mounted within a supply chamber (16) containing a molten reactant metal (15). The level of the molten reactant metal (15) in the supply chamber (16) resides above the level of the upper gas containment boundary (12). A circulating arrangement including a circulating paddle (17) circulates molten reactant metal (15) into the inlet end (23) of the reaction chamber (11) and through the reaction chamber to its outlet end (25). A mixing arrangement which may include fins (44) associated with the reaction chamber (11) mixes both gases and molten reactant metal in the reaction chamber to enhance exposure of unreacted gases to the molten metal. Gases exiting the reaction chamber (11) may be monitored to control the input of waste material at the inlet end (23) of the reaction chamber.

29 Claims, 6 Drawing Sheets

MOLTEN METAL REACTOR AND TREATMENT METHOD FOR TREATING GASEOUS MATERIALS AND MATERIALS WHICH INCLUDE VOLATILE COMPONENTS

TECHNICAL FIELD OF THE INVENTION

This invention relates to waste treatment systems which utilize a molten reactant metal and, more particularly, to waste treatment systems in which a molten reactant metal is used to treat gaseous waste materials or waste materials which include volatile components.

BACKGROUND OF THE INVENTION

Molten metals have been used to treat hazardous materials, particularly hazardous organic materials. U.S. Pat. No. 5,000,101 to Wagner (the "Wagner Patent") discloses a molten metal reactor and reactant metal suitable for treating organic materials. U.S. Pat. No. 4,666,696 to Schultz (the "Schultz Patent") discloses a molten metal reactor for treating gaseous hazardous materials.

In a molten reactant metal treatment process, the molten reactant metal is contained in a reaction chamber purged of oxygen and the material to be treated is placed in contact with the molten reactant metal. As disclosed in the Wagner Patent, the molten reactant metal strips halogen atoms from organic materials, producing predominantly metal salts and liberating carbon, hydrogen, and nitrogen. Much of the carbon goes to a gaseous state and releases from the molten reactant metal along with hydrogen gas and nitrogen gas. Some metal salts may also go to a gaseous state at the temperature of the molten reactant metal, and release from the molten reactant metal. Metal atoms released from the material being treated commonly alloy with the molten reactant metal. Other elements which do not react with the molten reactant metal, along with oxides (slag), some metal salts, and some of the liberated carbon may collect at the surface of the molten reactant metal as solids or liquids.

A difficulty may arise in treating gaseous materials or materials which include volatile components. The heat of the molten reactant metal quickly volatilizes volatile components and drives off the volatilized components along with other gaseous materials to be treated. The unreacted or partially reacted gaseous products which are out of contact with the reactant metal cannot chemically react with the reactant metal. Unreacted and partially reacted gaseous materials may undergo thermal decomposition after they separate from the molten reactant metal or may react with any reactant metal vapor phase which may reside near the surface of the molten reactant metal. However, the desired reaction with the molten reactant metal requires direct contact between the unreacted and partially reacted materials and the reactant metal.

The Wagner and Schultz Patents both disclose releasing the material to be treated below the surface of the molten reactant metal. Although this ensures some contact between the gaseous material and the molten reactant metal, the gaseous material rapidly escapes to the surface of the molten reactant metal and separates to the area above the surface of the molten metal and any associated metal vapor phase. The Schultz Patent discloses a reactor having a series of chambers above a molten metal bath and a series of baffles under which the gases must pass to reach the reactor outlet. However, the molten metal bath disclosed in the Schultz Patent has little contact with the gaseous material, particularly after slag or other solid reaction products collect at the surface of the molten reactant metal.

SUMMARY OF THE INVENTION

It is an object of the invention to provide a molten metal reactor and treatment method for treating materials which include gases or volatile components.

For convenience of description, materials to be treated in the present treatment system will be referred to in this disclosure and the following claims as "waste material." As used herein, the term "waste material" includes any type of material which may be treated by the treatment apparatus and method according to the invention. For example, the "waste material" may include substantially any type of hydrocarbon material, particularly hazardous hydrocarbon materials such as halogenated hydrocarbons, various types of solvents, pesticides, and mixtures of these materials. A "waste material" is not in any way limited by the manner in which the material is generated or limited by the use for which the material was originally intended.

The apparatus according to the invention includes an elongated reaction chamber adapted to contain a molten reactant metal. The reaction chamber includes a gas containment boundary for trapping gases which are introduced into the reaction chamber or released from the molten reactant metal in the reaction chamber. The apparatus also includes a heater for heating a supply of reactant metal to a molten state and a circulating arrangement for circulating the molten reactant metal into and through the reaction chamber. A waste input arrangement admits waste material into the reaction chamber and a reaction product removal arrangement collects reaction products exiting the reaction chamber and contains the reaction products for removal from the system.

A mixing arrangement is associated with the reaction chamber and may include flow restricting arrangements, turbulence inducing devices, fins, weirs, baffles, or any combination of these devices. The purpose of the mixing arrangement is to mix gases contained within the reaction chamber and to mix the molten reactant metal in the reaction chamber to enhance the exposure of the unreacted gases to the molten reactant metal. This enhanced exposure allows the molten reactant metal to react fully with the unreacted gases which collect that the top of the reaction chamber below the gas containment boundary. By containing gases in the reaction chamber, particularly under an elevated pressure, by continuously circulating solid and liquid reaction products out of the reaction chamber, and by mixing both the gases and molten reactant metal at points within the reaction chamber, the treatment apparatus and method according to invention helps ensure complete reaction of gaseous waste materials.

The preferred reactant metal comprises an alloy including a large percentage of the aluminum metal. Other reactant metals which may be used in the present invention include alloys of magnesium and alloys of lithium. Regardless of the particular reactant metal employed, the reactant metal may be heated to a molten state by any suitable means including by electrical induction heating or by hydrocarbon fired burners. To prevent the reactant metal from reacting with oxygen to form oxides (slag), the molten metal is maintained in a substantially oxygen free atmosphere.

The reaction chamber is preferably mounted within a larger supply chamber containing a supply of molten reactant metal. An inlet arrangement associated with the reaction chamber provides fluid communication between molten metal in the supply chamber and molten metal in the reaction chamber. Also, the level of the molten reactant metal in the supply chamber is maintained above the level of the reaction chamber and particularly the gas containment boundary portion of the reaction chamber. The column of molten reactant metal in the supply chamber maintains a hydrostatic pressure within the reaction chamber. This hydrostatic pressure helps contain gasses in a gas containment area within the reaction chamber, below the gas containment boundary. In some forms of the invention, this hydrostatic pressure may be augmented by maintaining a positive pressure in the supply chamber in an area above the level of the molten reactant metal.

The preferred reaction chamber follows an arcuate path through the supply chamber from an inlet end to an outlet end. The inlet arrangement associated with the reaction chamber preferably includes a primary inlet opening which allows molten reactant metal to enter the inlet end of the reaction chamber. A number of secondary inlet openings are preferably spaced apart along the length of the reaction chamber. These secondary inlet openings provide additional locations where fresh molten reactant metal enters the reaction chamber, and thus improve both the circulation of molten reactant metal through the reaction chamber and the mixing within the chamber.

In one form of the invention the apparatus includes a monitoring system for monitoring the content of gases at least at the outlet of the reaction chamber. The monitoring system produces a control signal based upon the content of the gases, and this control signal can be used to control the injection or input rate of waste material into the reaction chamber. For example, the presence of unreacted gases above a certain concentration in the outlet end of the reaction chamber, may result in a control signal which significantly slows or temporarily stops the injection of additional waste material into the reaction chamber.

These and other objects, advantages, and features of the invention will be apparent from the following description of the preferred embodiments, considered along with the accompanying drawings.

DESCRIPTION OF THE PREFERRED EMBODIMENTS

Figure 1:
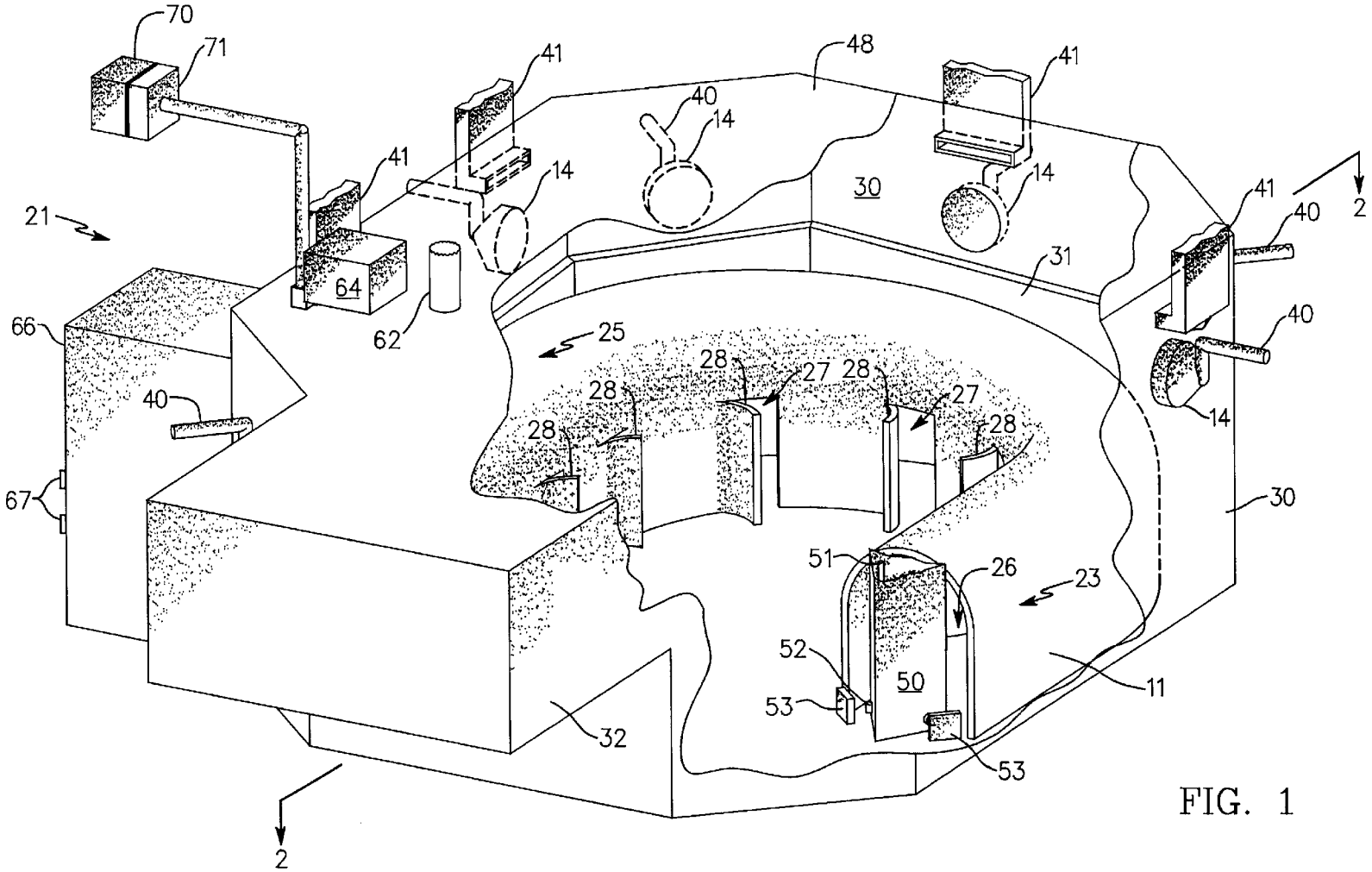
FIG. 1 is an isometric view of a waste treatment apparatus embodying the principles of the invention.
Figure 2:
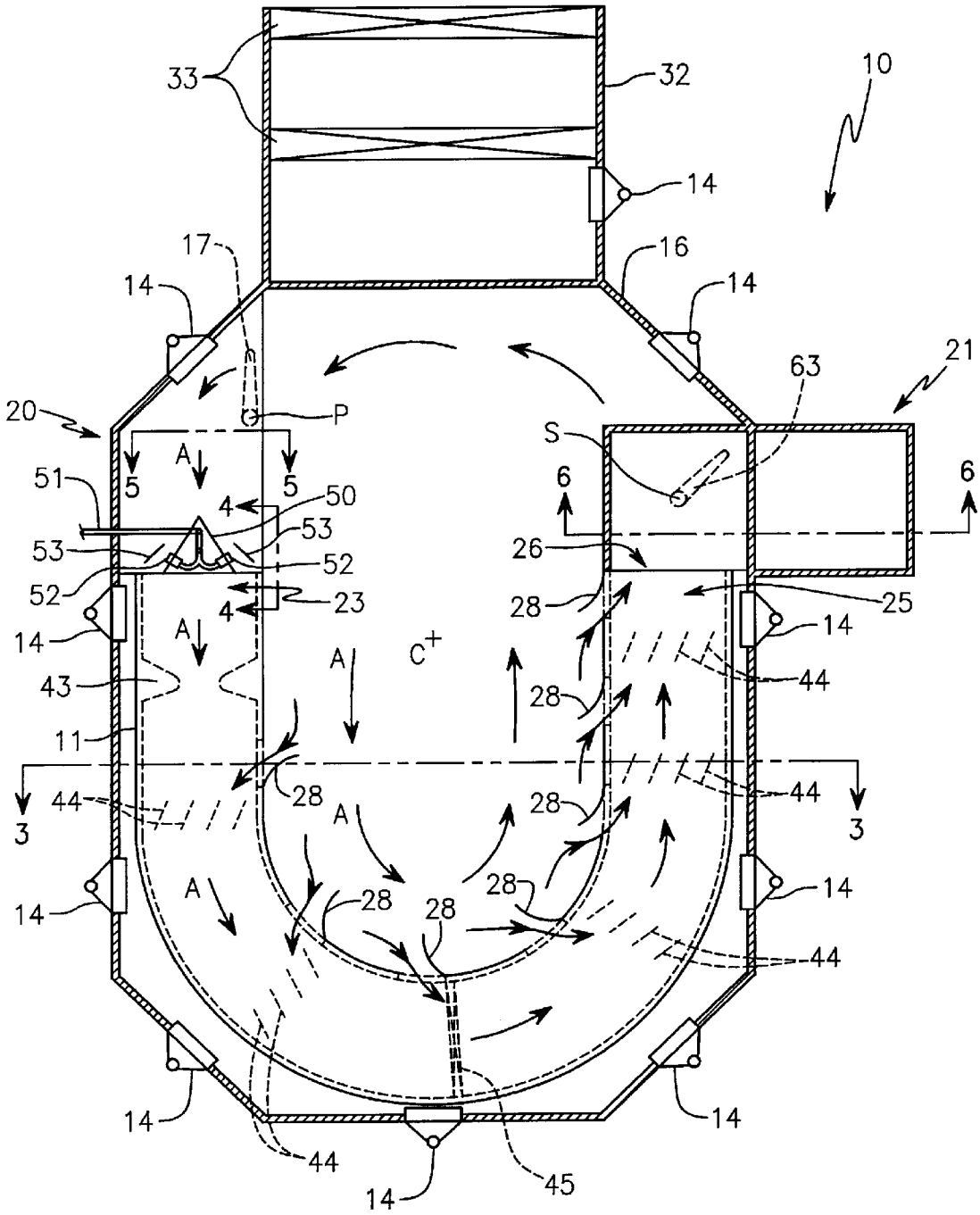
FIG. 2 is a somewhat diagrammatic view in section taken along line 2—2 in FIG. 1.
Figure 3:
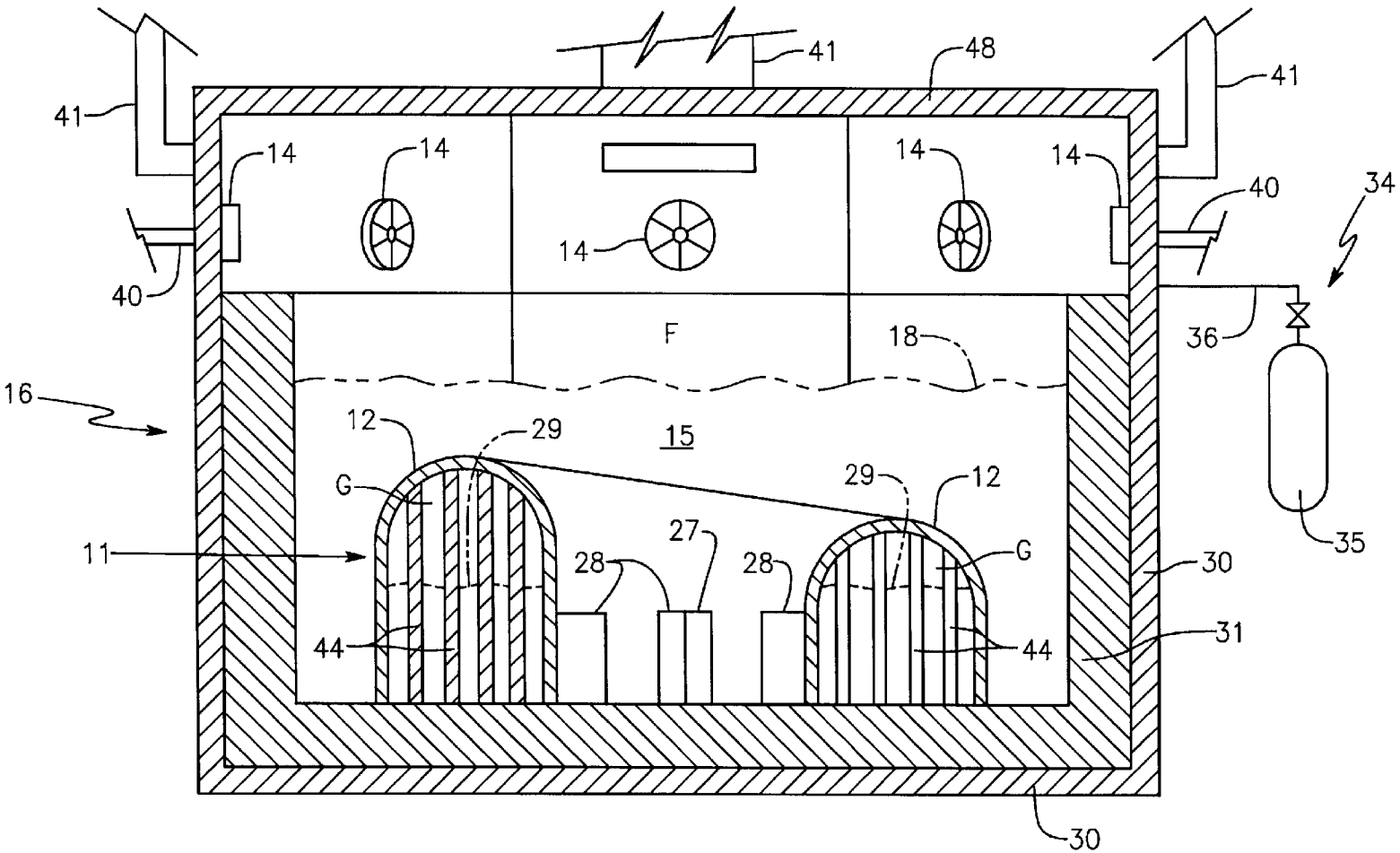
FIG. 3 is a view in section taken along line 3—3 in FIG. 2.

Referring to FIGS. 1 through 3, the treatment apparatus 10 according to the invention includes an elongated reaction chamber 11 having a gas containment boundary 12. A heater arrangement includes burners 14 for heating a supply of reactant metal 15 to a molten state in a supply chamber 16. A circulating arrangement includes stirring device 17 for circulating molten reactant metal 15 from supply chamber 16 to reaction chamber 11. The waste treatment apparatus 10 further includes a waste material input arrangement 20 shown in further detail in FIGS. 4 and 5, and a reaction product removal arrangement 21 shown in further detail in FIG. 6.

As shown best in FIGS. 2, and 3, the elongated reaction chamber 11 is mounted by suitable means (not shown) within supply chamber 16 and follows generally an arcuate path which defines a treatment path. Reaction chamber 11 includes an inlet end 23 having a primary inlet opening 24 through which fresh molten reactant metal is circulated and through which waste material to be treated (shown in FIG. 5) is admitted into the reaction chamber. The opposite end of reaction chamber 11 comprises an outlet end 25 having an outlet opening 26 through which reaction products are passed to the reaction product removal arrangement 21 shown particularly in FIG. 6.

The illustrated preferred form of the reaction chamber 11 further includes secondary inlet openings 27 spaced apart along the length of the reaction chamber on an inner side thereof as it follows its arcuate path through supply chamber 16. Each secondary inlet opening 27 preferably has associated with it a deflecting member 28 for deflecting or channeling molten reactant metal from supply chamber 16 into reaction chamber 11. As shown best in FIG. 3, the secondary inlet openings 27 are located at a bottom portion of reaction chamber 11, well below the gas containment boundary 12 and a reaction surface 29 which comprises the level of molten reactant metal in the reaction chamber 11. Reaction surface 29 and all other molten metal levels in the figures are shown as phantom lines. Although not shown in the drawings, reaction chamber 11 may also include circulation outlet openings spaced apart along the length of the reaction chamber on the side of the chamber opposite the side having secondary inlet openings 27. These additional openings would also be at a bottom of reaction chamber 11, well below reaction surface 29.

As shown in FIG. 3, reaction chamber 11 slopes upwardly from its inlet end 23 to its outlet end 25. Although the illustrated preferred form of reaction chamber 11 shown in the figures slopes upwardly continuously from its inlet to outlet end, those skilled in the art will appreciate that the height of reaction chamber 11 may alternatively increase in discrete steps from inlet end 23 to outlet end 25. In yet other forms of the invention, the reaction chamber may have a substantially constant height along its entire length. Supply chamber 16 comprises a covered and substantially sealed vessel adapted to contain a supply of molten reactant metal 15. The level of molten reactant metal 15 in supply chamber 16 is shown at phantom line 18 in FIGS. 3, 4, 5, and 6. The vessel side and bottom walls 30 are formed from any suitable material, preferably steel, lined with a refractory material 31 such as silica bricks or a continuous layer of ceramic material. Both walls 30 and refractory material 31 are shown in exaggerated scale for purposes of illustrating the invention. Refractory material 31 is required in order to protect the vessel walls 30 from reacting or alloying with molten reactant metal 15 contained within supply chamber 16 and reaction chamber 11. It will be understood that all of the components of the waste treatment apparatus 10 which come in contact, or may come in contact, with the molten reactant metal 15 must ordinarily be protected from the reactant metal by a coating of suitable refractory material. Most components of the treatment apparatus which come in contact with molten reactant metal 15 may be made of a steel core or substructure which is then coated or otherwise covered with a layer of refractory material such as fused silica or a ceramic material. The layers of refractory material are omitted from most components in the drawings so as not to obscure the invention in unnecessary detail. Also, those skilled in the art will appreciate that any substructure for the various components of apparatus 10 must generally be made of a material which retains substantial strength at the temperature of the molten reactant metal, approximately 800 degrees centigrade or above. Since reactant metal is consumed in the formation of reaction products in reaction chamber 11, supply chamber 16 preferably includes a charging arrangement through which additional reactant metal may be added. The illustrated charging arrangement includes a charging chamber 32 having at least two airlock doors 33 and at least one burner 14 for melting the added metal. When reactant metal is added while the treatment apparatus is in operation, the airlock doors are operated so that one door is closed at all times, thereby limiting the amount of oxygen which is admitted into supply chamber 16 as metal is added. Also, although not shown in the figures, supply chamber 16 may also include a drain through which molten reactant metal may be drained. Draining supply chamber 16 may be required periodically to allow the system to be serviced.

The preferred supply chamber 16 also has associated with it a purging arrangement 34 (FIG. 3) for purging the chamber of oxygen prior to startup. The purging arrangement 34 may also extend to purge the charging chamber 32 and comprises a suitable inert gas supply 35 connected by suitable control valving (not shown) and connecting lines 36 to selectively release inert gas such as nitrogen into supply chamber 16 (and charging chamber 32) to displace air or other gasses which may have collected. An oxygen free environment is maintained in supply chamber 16 to prevent the reactant metal from reacting with oxygen to form oxides which commonly collect as slag at the surface of the molten reactant metal.

As shown in FIG. 3, the level 18 of molten reactant metal in supply chamber 16 extends well above the height of reaction chamber 11, even at boundary 12 which is the highest point of the reaction chamber. The column of molten reactant metal 15 above the level of the gas containment boundary 12 maintains hydrostatic pressure preferably between one-half to 3 psig on gasses which collect in a gas containment area G at the top of reaction chamber 11 above reaction surface 29. The pressure in gas containment area G may be increased further by increasing the level of molten reactant metal in supply chamber 16 and/or maintaining a positive pressure in the area F above the level 18 of molten reactant metal 15 in supply chamber 16.

The heating arrangement in the illustrated form of the invention comprises a plurality of hydrocarbon fueled burners 14 placed around the periphery of supply chamber 16 above the level 18 of molten reactant metal 15. Each of the burners 14 receives fuel through a suitable fuel line 40 and includes regulation equipment (not shown) for regulating the heat output from the respective burner. Oxygen to the burners is limited to generally the amount required for combustion of the burner fuel to prevent excess oxygen from building up in area F. Supply chamber 16 also includes a series of flue gas ducts 41 for removing exhaust gases which collect in area F of supply chamber 16 above the level of molten reactant metal 15. It will be noted that the flue gases are entirely isolated from any reaction product gases and waste materials which are introduced into reaction chamber 11.

Although the hydrocarbon fired burners 14 are shown for purposes of illustrating the invention, those skilled in the art will appreciate that any suitable heating arrangement may be used to heat the reactant metal and maintain the reactant metal in the desired molten state. For aluminum-based reactant metals the desired molten state is at a temperature above approximately 800 degrees centigrade. These other heating arrangements, including electrical induction heating arrangements, are to be considered equivalents of the hydrocarbon fired heating arrangement shown in the figures.

The reactant metal may comprise any suitable reactant metal for reacting with the material to be treated, and preferably comprises an alloy including a large percentage of aluminum. The reactant metal alloy described in U.S. Pat. No. 5,000,101 to Wagner is an example of a reactant metal suitable for use in the present invention. That reactant metal alloy comprises approximately 5% to 15% iron, 5% to 15% zinc, 5% to 15% calcium, 5% to 15% copper, and the remainder aluminum, with all percentages expressed as a weight percentage of the total weight of a given quantity of alloy. Alternatively, the reactant metal within the scope of the invention may comprise substantially 100% aluminum made up from any source including scrap aluminum. However, the invention is not limited to aluminum or reactant alloys in which aluminum is the primary component. For example, alloys of lithium and alloys of magnesium may also be used as molten reactant metal 15 within the scope of the invention.

Referring particularly to FIG. 2, the circulating paddle 17 circulates molten reactant metal 15 counter clockwise within supply chamber 16 and reaction chamber 11 as indicated by the arrows A. In the preferred form of the circulating arrangement, paddle 17 is rotated by a suitable drive motor (not shown) about axis P extending perpendicular to the drawing sheet from approximately the three o'clock position counter clockwise to approximately the 6 o'clock position. From the 6 o'clock position, paddle 17 is allowed to be carried by the flow of molten reactant metal back to the three o'clock position where the paddle is again driven counter clockwise about axis P. The drive mechanism for paddle 17 is omitted from the drawing so as not to obscure the invention in unnecessary detail; however, such drive mechanisms are well within the knowledge of those skilled in this filed. Other forms of the circulating arrangement may include additional or alternative stirring devices to maintain the desired flow of molten reactant metal 15 in supply chamber 16 and through reaction chamber 11 from inlet end 23 to outlet end 25. For example, a single stirring device (not shown) may be placed generally in the center C of supply chamber and rotated by a suitable drive mechanism continuously about a vertical axis, that is, an axis perpendicular to the drawing sheet in FIG. 2. Pumping arrangements may also be used for pumping the molten reactant metal to maintain the desired flow in reaction chamber 11.

Treatment apparatus 10 further includes a mixing arrangement for mixing both the molten reactant metal 15 in the reaction chamber 11 and the gases which collect in gas containment area G at the top of the reaction chamber. In particular, the mixing arrangement continuously breaks the reaction surface 29 of molten reactant metal 15, thereby continuously exposing gases in the gas containment area G to fresh molten reactant metal. This continuous exposure of gases in gas containment area G to fresh molten reactant metal 15 facilitates complete reaction of the gaseous waste material which initially collects in the gas containment area G near the inlet end 23 of reaction chamber 11. Continuously exposing fresh reactant metal at reaction surface 29 also encourages a thin reactant metal vapor phase just above the reaction surface in reaction chamber 11. The continuous mixing within reaction chamber 11, along with containment of unreacted gaseous material within the gas containment area G in close proximity to molten reactant metal 15 results in essentially complete reaction of waste products with the reactant metal within reaction chamber 11. The essentially complete reaction leaves only gaseous reaction products in the gas containment area G at the outlet end 25 of reaction chamber 11, along with solid or liquid reaction products collected at the surface of molten reactant metal 15 in the reaction chamber.

The preferred mixing arrangement includes a series of individual mixing devices spaced apart along the length of reaction chamber 11, and may include flow restricting devices, fins, weirs, baffles, or turbulence inducing devices. Referring particularly to FIGS. 2 and 3, the illustrated mixing arrangement includes a flow restricting arrangement 43 near the inlet end 23 of reaction chamber 11, a series of fins 44 arranged together in groups spaced apart along the length of reaction chamber 11, and a weir 45 (FIG. 2). Each fin 44 in each group of fins extends vertically from the top of reaction chamber 11 to the bottom of the reaction chamber. Also, each fin 44 is angled with respect to the direction A of reactant metal flow through reaction chamber 11. As molten reactant metal flows through reaction chamber 11, each fin 44 breaks the surface of molten reactant metal 15 allowing fresh molten reactant metal to come to the surface in the area immediately downstream from the respective fin. The flow restricting arrangement 43 not only induces turbulence in the reactant metal 15 and gases in gas containment area G, but also encourages fresh molten reactant metal to flow into reaction chamber 11 through secondary inlet openings 27. This flow of fresh molten reactant metal 15 into reaction chamber 11 through secondary inlet openings 27, combined with the mixing produced by fins 44 and weir 45 included in the reaction chamber, insures a thorough mixing of molten reactant metal 15 in the reaction chamber and prevents pockets of relatively cooler reactant metal from forming and interfering with the desired reaction.

Figure 4:
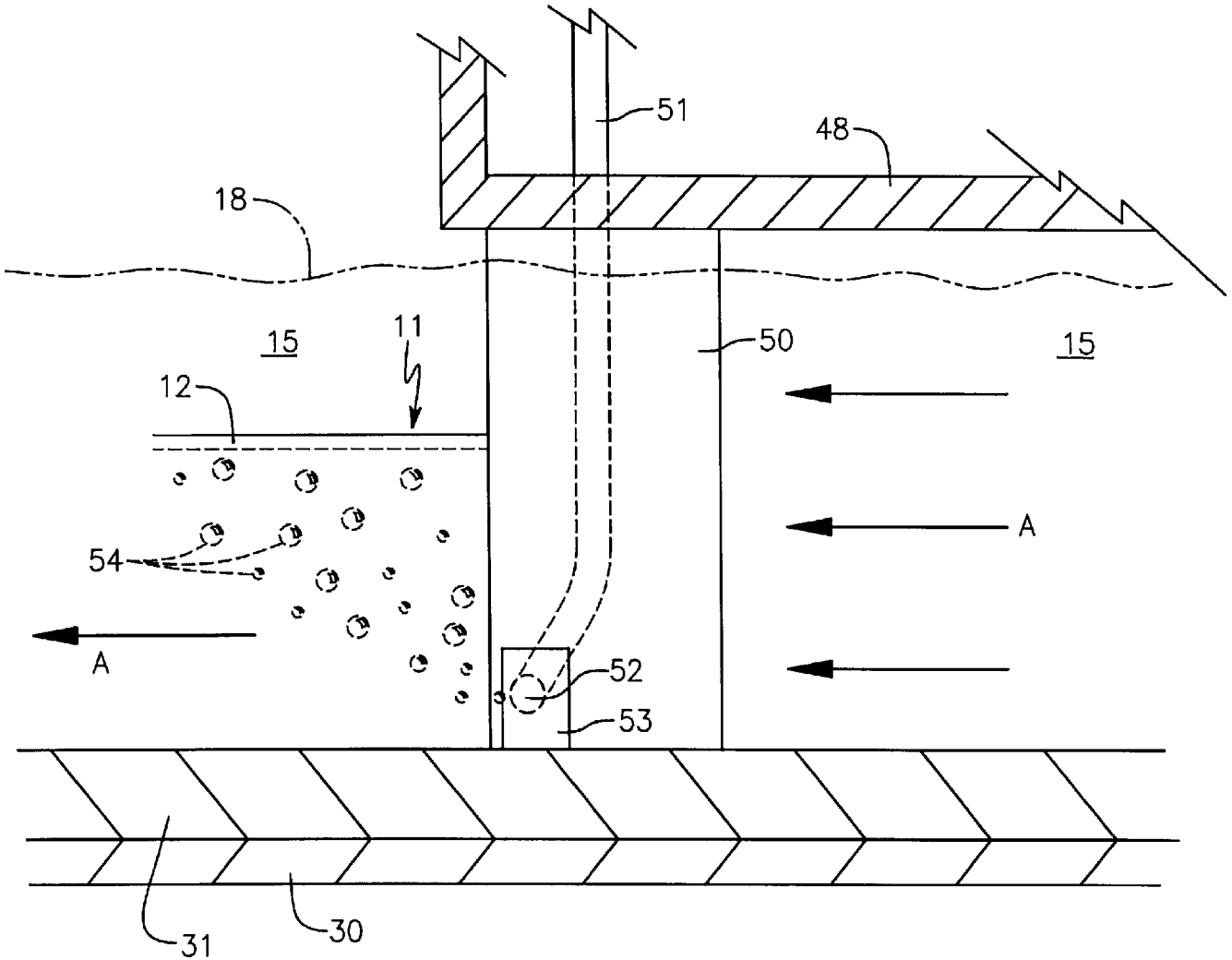
FIG. 4 is a view in section taken along line 4—4 in FIG. 2.
Figure 5:
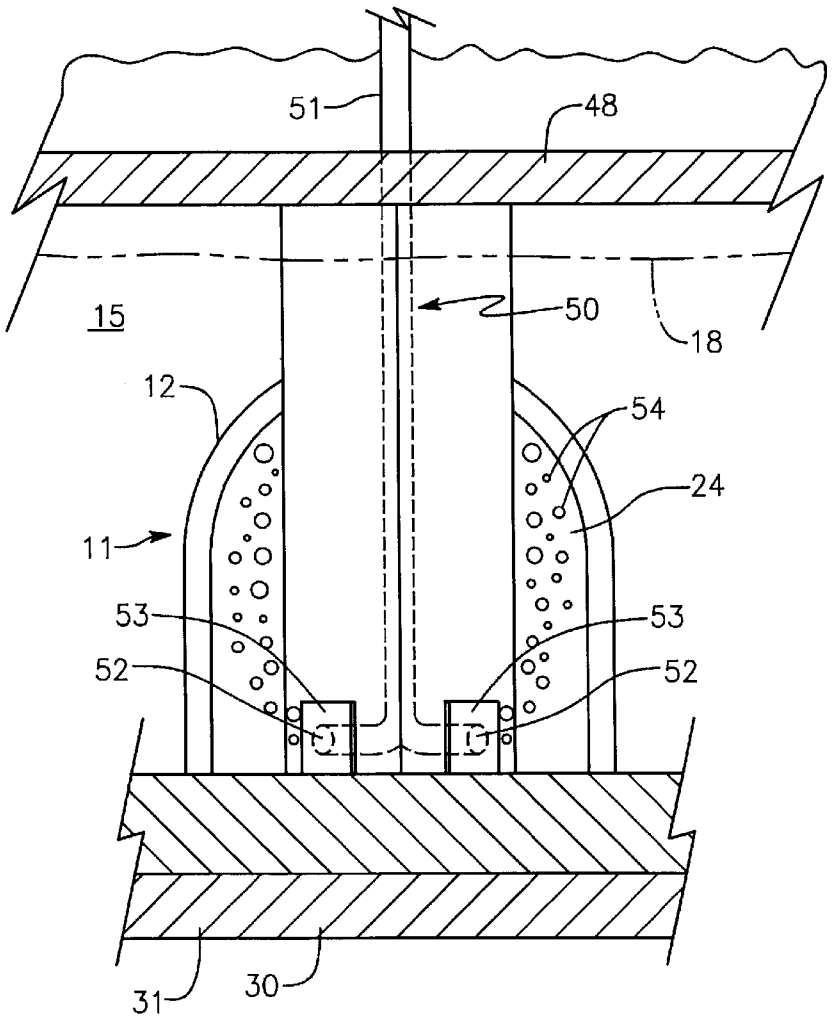
FIG. 5 is a view in section taken long line 5—5 in FIG. 2.

Referring to FIGS. 4 and 5 in addition to FIG. 2, the waste input arrangement 20 includes an isolating chamber 50 formed near the inlet end 23 of reaction chamber 11. In the illustrated form of the invention, isolating chamber 50 has a triangular shape in transverse section as seen in FIG. 2. The base of the triangular shape blocks a substantial portion of inlet opening 24 at the inlet end 23 of reaction chamber 11. Isolation chamber 50 extends through the top 48 (shown in exaggerated thickness) of supply chamber 16 downwardly to the bottom or near the bottom of the supply chamber, and is sealed so as to exclude molten reactant metal from the interior area I shown in FIG. 2. Waste input tubing 51 extends into isolation chamber 50 and directs waste material from a waste supply container (not shown) to at least one nozzle 52. Nozzles 52 are preferably located near the bottom of supply chamber 16 either just outside the inlet opening 24 of reaction chamber 11 or actually within the inlet end 23 of the reaction chamber. Waste material is pumped or otherwise forced under pressure through lines 51 and sprays from each nozzle 52 preferably toward a dispersing plate 53. Each dispersing plate 53 breaks up the stream of waste material into a plurality of discrete bubbles 54 to maximize the surface contact area between the waste material and the reactant metal.

Since the level of each waste input nozzle 52 is well below the surface of molten reactant metal 15, a sufficient pressure is maintained within the waste input lines 51 to ensure 40 that molten reactant metal 15 may not flow back into the nozzles 52. A purging arrangement (not shown) may also be included for purging line 51 and nozzles 52. Also, suitable check valves (not shown) may be used to prevent flow of molten reactant metal 15 into the nozzles 52 and waste input lines 51. Waste input arrangement 20 may also include means (not shown) in addition to the open area I for preventing the waste material in waste input lines 51 from being heated excessively. The purpose of such cooling means is to prevent waste material from pyrolizing appreciably within line 51 or nozzles 52.

Figure 6:
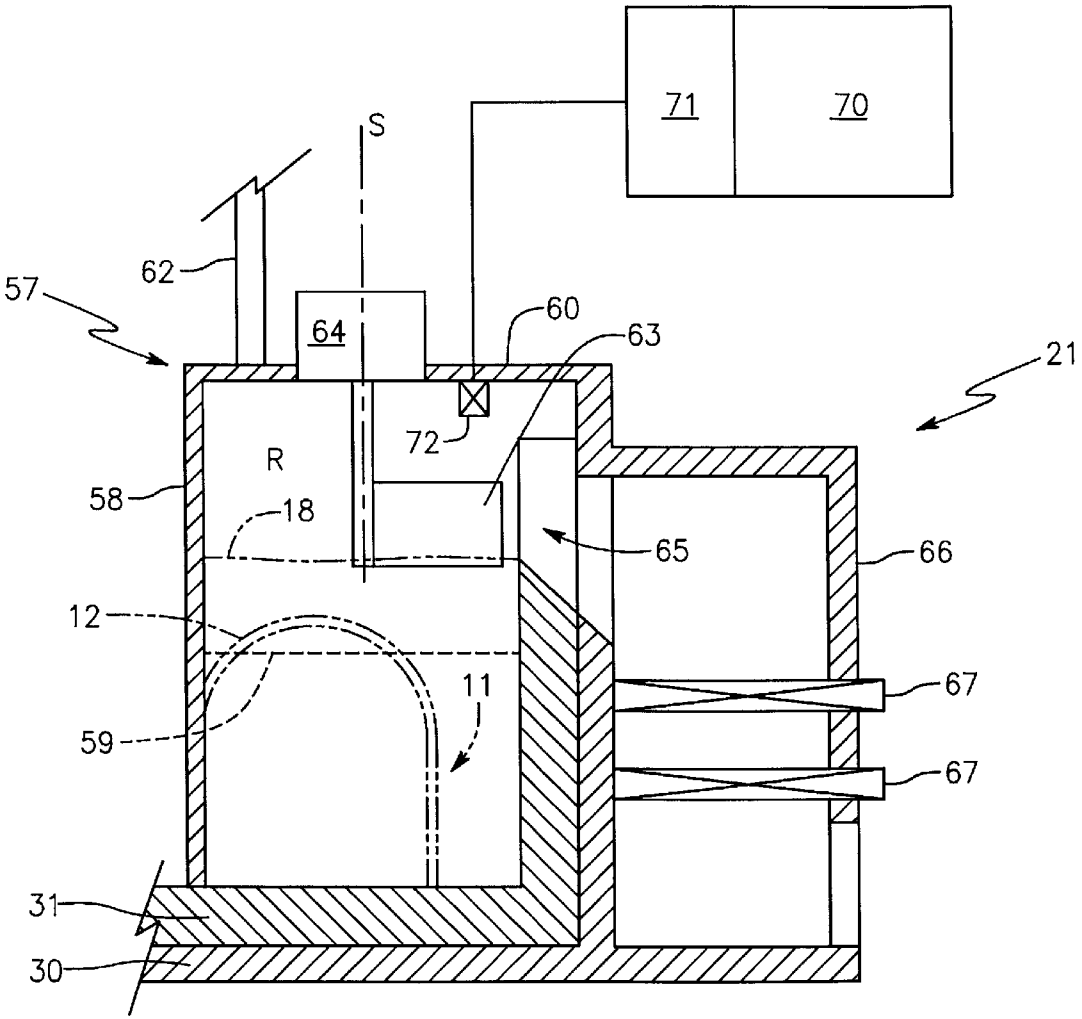
FIG. 6 is a somewhat diagrammatic view in section taken along line 6—6 in FIG. 2.

Referring now to FIG. 6 in addition to FIG. 2, reaction product removal arrangement 21 includes an outlet chamber 57 located at the outlet end 25 of reaction chamber 11. Outlet chamber 57 defines an area R for receiving gaseous reaction products from the reaction chamber outlet opening 26 along with any solids or liquid reaction products which may collect at the surface of molten the reactant metal 15 in the reaction chamber. The outlet chamber walls 58 extend downwardly from the top 60 of the outlet chamber 57 to a lower edge 59 at a level below the surface of molten reactant metal 15 in supply chamber 16. Thus, all gaseous reaction products exiting the reaction chamber outlet opening 26 collect in area R of the outlet chamber 57 and are prevented from mixing with flue gases in area F above the molten metal 15 within supply chamber 16.

Gaseous reaction products exit treatment apparatus 10 through an output line 62 while a skimming paddle 63 skims most liquid and solid reaction products off the surface of the molten reactant metal 15 in the outlet chamber 57. The skimming paddle 63 is preferably rotated about a vertical axis S by a suitable motor 64. The skimmed solid and liquid reaction products pass through a side opening 65 into an outlet chute 66. Outlet chute 66 includes a series of airlock doors 67 which are opened in sequence to allow the collected material to drop out of the outlet chute 66 without leaving the outlet chute and outlet chamber 57 open to the atmosphere. Any solid or liquid reaction products which are heavier than molten reactant metal 15 pass under the lower edge 59 of walls 58 and into supply chamber 16. These materials may be drawn off the bottom of supply chamber 16 by suitable means or may simply be allowed to collect until the reactant metal supply must be removed and replaced. The gaseous reaction products are preferably directed to a material recovery arrangement (not shown) for recovering the various reaction products contained in the gas. The material recovery arrangement preferably includes an aqueous scrubber, a solids separator, and perhaps and evaporator such as those described in U.S. Pat. No. 5,000,101 to Wagner. This preferred material recovery arrangement recovers solid carbon, metal salts, and water. Hydrogen and nitrogen gas may also be recovered from the gas exiting the treatment apparatus 10 through line 62.

One preferred form of the invention includes a monitoring arrangement for monitoring the content of the gas collecting in outlet chamber 57. The monitoring arrangement includes a control unit 70, an analyzing unit 71, and at least one vent 72 for withdrawing gas to be monitored. Analyzing unit 71 preferably comprises a flame ionization unit capable of detecting the level of unreacted gases which may be present in outlet chamber 57. Control unit 70 is adapted to produce a control signal based on the content of gas as measured by analyzing unit 71. This control signal may be used to optimize the rate at which waste material is injected through nozzles 52, or may be used to stop or reduce the injection rate in the event unreacted gases are detected in concentrations over a maximum allowable level.

The operation of the invention may be described with particular reference to FIGS. 2, 3, and 4. Referring to FIG. 4, waste material is injected into molten reactant metal 15 through one or more waste injection nozzles 52 located near or at the inlet end 23 of reaction chamber 11. The injected waste is preferably maintained below a pyrolizing temperature in inlet lines 51 by cooling means which may comprise an arrangement for circulating a cooling fluid through area I (FIG. 2) of isolation chamber 50. The waste material is directed by each nozzle 52 a short distance through the molten reactant metal 15 to the dispersing plates 53 where the waste material is dispersed into small bubbles 54 of waste material in liquid or gaseous form. Reaction with the molten reactant metal 15 begins immediately at each bubble 54 across the entire surface of each bubble. The flow of molten reactant metal 15 as indicated by arrows A carries all of the waste material bubbles 54 and reaction products into the inlet opening 24 of reaction chamber 11. Gases, including both reaction product gases and unreacted waste material, collect in the gas containment area G of reaction chamber 11 below gas containment boundary 12. Waste material is injected at a rate which is low enough to prevent an excessive volume of gas from collecting in reaction chamber 11. In particular, the injection rate is maintained low enough to prevent the reaction surface 29 shown in FIG. 3 from dropping to the level of secondary inlet openings 27. Thus, the injection rate is controlled to prevent gases from flowing out openings 27 into supply chamber 16.

The column of molten reactant metal 15 above the bubbles 54 of waste material and above the level of the gas containment area G maintains a hydrostatic pressure on all of the gaseous waste material in reaction chamber 11. This elevated pressure helps contain the gaseous waste material in reaction chamber 11 above the level of openings 27 and helps enhance the reaction rate to ensure complete reaction within the reaction chamber.

The circulating arrangement, including circulating paddle 17, maintains a constant circulation of molten reactant metal in the direction of arrows A shown best in FIG. 2. Gas which collects in gas containment area G (FIG. 3) at the top of reaction chamber 11 flows toward the outlet end 25 of reaction chamber 11 and to the area R in outlet chamber 57. Collected gasses are drawn off through outlet line 62 to maintain the pressure in area R at a level which facilitates the flow of gas through reaction chamber 11 in the direction of arrows A. As molten reactant metal 15 and gases flow through reaction chamber 11 toward outlet end 25, the mixing devices, such as fins 44 shown in FIGS. 2 and 3, help mix both the gaseous material and also molten reactant metal 15. In particular, fins 44 break the surface of molten reactant metal 15 and allow fresh material to come to the surface, displacing any reaction products which may collect at the reaction surface 29 (FIG. 3). This surface mixing action encourages a portion of the reactant metal to go to a vapor phase in the area just above the level of the molten metal. The metal vapor phase enhances the desired reaction with gaseous waste material in gas containment area G.

As molten reactant metal 15 circulates within supply chamber 16, a portion of the reactant metal is deflected into reaction chamber 11 by deflecting members 28 associated with secondary inlet openings 27. Thus, in addition to reactant metal which enters reaction chamber 11 at inlet opening 24, fresh molten reactant metal is continuously introduced into the reaction chamber at various locations along the length of the reaction chamber. The flow restricting device shown at reference number 43 in FIG. 2, particularly combined with flow restricting effect caused by isolation chamber 50, may also produce a relatively low pressure in the area immediately downstream of the flow restricting device. This pressure reduction in reaction chamber 11 helps draw molten reactant metal into the reaction chamber through secondary inlet openings 27.

Molten reactant metal within reaction chamber 11 eventually flows out of the reaction chamber through outlet opening 26, carrying with it liquid and solid reaction products and any slag (oxides) which may form. Substantially all of the solid and liquid reaction products and slag collect at the surface of molten reactant metal 15 in outlet chamber 57. However, molten reactant metal 15 exiting reaction chamber 11 flows underneath the bottom 59 of outlet chamber walls 58 back into the supply chamber 16 where the material is mixed and heated prior to circulating again into the reaction chamber.

Solids and liquid reaction products along with slag which all collect that the surface of molten reactant metal 15 in outlet chamber 57 are skimmed or scraped by skimming member 63 off into outlet chute 66. To remove material without allowing substantial amounts of air to enter the system, the top airlock door 67 is opened to allow material in the chute 66 to fall into the area between doors 67. Then the upper door 67 is closed and the lower door 67 opened to allow the collected material to drop out into a suitable receptacle (not shown). The above described preferred embodiments are intended to illustrate the principles of the invention, but not to limit the scope of the invention. Various other embodiments and modifications to these preferred embodiments may be made by those skilled in the art without departing from the scope of the following claims. For example, although reaction chamber 11 is illustrated as residing in supply chamber 16, it will be understood that the reaction chamber may be separate from any supply chamber. In some forms of the invention, there may be no separate supply of molten reactant metal aside from the supply within the reaction chamber itself. In any case molten reactant metal may be pumped or otherwise circulated through reaction chamber 11 by any suitable means. Also, certain features of the invention, such as airlock doors 33, and 67, for example, are shown diagrammatically so as not to obscure the invention in unnecessary detail. Those skilled in the art wall appreciate that these features may comprise any arrangement for performing the indicated function and such arrangements are to be considered within the scope of the disclosure and the following claims.

What is claimed is:

1. A waste treatment apparatus comprising:

(a) an elongated reaction chamber, the elongated reaction chamber having an inlet end and an outlet end, and also including a gas containment boundary extending along its length;

(b) a supply chamber containing a supply of reactant metal;

(c) a heater for maintaining at least a portion of the reactant metal in the supply chamber in a molten state;

(d) a circulating arrangement for circulating molten reactant metal in a circuit from the supply chamber through the reaction chamber in the direction from the inlet end to the outlet end;

(e) a mixing arrangement for mixing molten reactant metal within the reaction chamber and for mixing gases contained within the reaction chamber;

(f) a waste input arrangement for admitting waste material into the reaction chamber; and (g) a reaction product removal arrangement for receiving reaction products from the reaction chamber.

2. The apparatus of claim 1 further comprising:

(a) pressurizing means for maintaining a gas containment pressure within the reaction chamber.

3. The apparatus of claim 1 wherein the reactant metal comprises an alloy including at least one metal chosen from the group consisting of aluminum, magnesium, and lithium.

4. The apparatus of claim 1 wherein the inlet arrangement comprises:

(a) a primary opening at the inlet end of the reaction chamber; and (b) a plurality of secondary openings into the reaction chamber from the supply chamber, the plurality of secondary openings being spaced apart along the length of the reaction chamber.

5. The apparatus of claim 4 wherein:

(a) the reaction chamber is contained within the supply chamber with the gas containment boundary being positioned below the surface of the molten reactant metal in the supply chamber; and (b) the circulating arrangement includes (i) a plurality of deflector members each deflector member associated with a different secondary opening, and (ii) a circulating device which directs molten reactant metal into the reaction chamber through the primary opening, and toward the deflector members to be deflected into the reaction chamber.

6. The apparatus of claim 1 wherein the mixing arrangement includes a plurality of turbulence inducing devices within the reaction chamber.

7. The apparatus of claim 1 wherein the mixing arrangement includes at least one weir within the reaction chamber.

8. The apparatus of claim 1 wherein the reaction product removal arrangement includes an outlet chamber at the outlet end of the reaction chamber in position to receive reaction products which flow out of the outlet end of the reaction chamber, the outlet chamber isolating the reaction products from the supply chamber, and further comprising:

(a) a gas removal conduit connected to the outlet chamber; and (b) a solid/liquid removal arrangement for removing solid and liquid reaction products which collect at the surface of the molten reactant metal in the outlet chamber.

9. The apparatus of claim 1 wherein the height of the reaction chamber increases from the inlet end toward the outlet end.

10. The apparatus of claim 1 wherein the waste input arrangement comprises:

(a) an injector positioned at the inlet end of the reaction chamber and generally at a bottom portion of the reaction chamber; and (b) a cooling arrangement for removing heat from an injection line which feeds waste material to the injector.

11. The apparatus of claim 10 further comprising a dispersing member positioned in front of the injector.

12. A method of treating waste material, the method comprising the steps of:

(a) admitting waste material into a reaction chamber containing a volume of molten reactant metal;

(b) in a gas containment area in the reaction chamber, containing gases released from the molten reactant metal, the gases including both unreacted gases and reaction product gases, the gas containment area being in contact with a reaction surface of the molten reactant metal;

(c) mixing the molten reactant metal at one or more points within the reaction chamber to replace molten reactant metal at the reaction surface with fresh molten reactant metal from an area of the reaction chamber below the reaction surface; and (d) mixing the gases in the containment area to enhance contact between the reaction surface and the unreacted gases.

13. The method of claim 12 including the step of:

(a) maintaining the gas containment area under a treatment pressure, the treatment pressure being a pressure substantially over atmospheric pressure.

14. The method of claim 13 wherein the treatment pressure is in a range from approximately one-half psig to approximately 3 psig.

15. The method of claim 13 wherein the step the maintaining the treatment pressure comprises:

(a) maintaining the molten reactant metal in the reaction chamber in contact with a column of molten reactant metal extending above the level of the gas containment area.

16. The method of claim 12 wherein the step of containing gases in the gas containment area comprises:

(a) capturing gases beneath a gas containment boundary located within a molten reactant metal bath below the surface of the molten reactant metal bath, the gas containment boundary comprising an upper boundary of the reaction chamber.

17. The method of claim 16 further comprising the step of:

(a) directing gases in the gas containment area along a treatment path from a reaction chamber inlet to a reaction chamber outlet; and (b) wherein the step of mixing the molten reactant metal comprises the step of breaking the reaction surface as the molten reactant metal flows along the treatment path.

18. The method of claim 17 including the step of:

(a) introducing molten reactant metal from the molten metal bath into the reaction chamber at a plurality of locations spaced apart along the treatment path.

19. The method of claim 18 further comprising the step of:

(a) circulating molten reactant metal in the bath within which the reaction chamber is positioned, and thereby directing molten reactant metal from the bath into the reaction chamber through (i) a primary inlet opening at an inlet end of the reaction chamber, and (ii) a plurality of secondary openings spaced apart along the treatment path.

20. In a molten metal reactor having a reaction chamber containing a volume of molten reactant metal for reacting with waste material introduced into the reaction chamber, the improvements comprising:

(a) a gas containment area for containing gases released from the molten reactant metal, the gases including unreacted gases and reaction product gases;

(b) a mixing arrangement for mixing the molten metal at a surface thereof which defines a boundary of the gas containment area, the mixing bringing fresh molten reactant metal to the surface; and (c) a reaction product removal arrangement for receiving reaction products from the reaction chamber, and containing the reaction products in an isolated position to be removed from the molten metal reactor.

21. The molten metal reactor of claim 20 further comprising:

(a) pressurizing means for maintaining a containment pressure within the gas containment area.

22. The molten metal reactor of claim 20 further comprising:

(a) a supply chamber for containing a supply of molten reactant metal;

(b) an inlet arrangement for enabling molten reactant metal to pass from the supply chamber to the reaction chamber; and (c) wherein the circulating arrangement circulates molten reactant metal from the supply chamber into the reaction chamber.

23. The molten metal reactor of claim 22 wherein the reaction chamber comprises an elongated chamber and the inlet arrangement comprises:

(a) a primary inlet opening at an inlet end of the reaction chamber; and (b) a plurality of secondary openings into the reaction chamber from the supply chamber, the plurality of secondary openings being spaced apart along the length of the reaction chamber.

24. The molten metal reactor of claim 23 wherein the height of the reaction chamber increases from the inlet end to an outlet end of the reaction chamber.

25. The molten metal reactor of claim 23 wherein each secondary opening has associated with it a deflector member for reflecting molten reactant metal from the supply chamber into the reaction chamber through the respective secondary opening.

26. The molten metal reactor of claim 25 wherein:

(a) the reaction chamber is contained within the supply chamber with an upper boundary of the reaction chamber being positioned below the surface of the molten reactant metal in the supply chamber; and (b) the circulating arrangement includes a circulating device which directs molten reactant metal (i) into the reaction chamber through the primary inlet opening, and (ii) toward the deflector members to be deflected into the reaction chamber.

27. The molten metal reactor of claim 20 wherein the mixing arrangement includes a plurality of members for breaking a surface of the molten reactant metal which defines a boundary of the gas containment area.

28. A waste treatment apparatus comprising:

(a) an elongated reaction chamber, the elongated reaction chamber having an inlet end and an outlet end, and also including a gas containment boundary extending along its length;

(b) a heater for heating a reactant metal to a molten state;

(c) a circulating arrangement for circulating molten reactant metal through the reaction chamber in the direction from the inlet end to the outlet end;

(d) a mixing arrangement for mixing molten reactant metal within the reaction chamber and for mixing gases contained within the reaction chamber;

(e) a waste input arrangement for admitting waste material into the reaction chamber;

(f) a reaction product removal arrangement for receiving reaction products from the reaction chamber; and (g) pressurizing means for maintaining a gas containment pressure within the reaction chamber.

29. The waste treatment apparatus of claim 28 wherein the pressurizing means includes:

(a) a column of the molten reactant metal in communication with the reaction chamber and extending above the level of the reaction chamber.

* * * * *

UNITED STATES PATENT AND TRADEMARK OFFICE

CERTIFICATE OF CORRECTION

PATENT NO. : 6,227,126 B1
DATED : May 8, 2001
INVENTOR(S) : Anthony S. Wagner

It is certified that error appears in the above-identified patent and that said Letters Patent is hereby corrected as shown below:

Column 2,
Line 43, change "that" to -- at --.

Column 6,
Line 43, change "filed" to -- field --.

Column 10,
Line 11, change "that" to -- at --.
Line 19, begin new paragraph at "The above described"

Column 12,
Line 8, change "the step the" to -- the step of --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*